US010322495B2

(12) United States Patent
Alkhalaileh et al.

(10) Patent No.: US 10,322,495 B2
(45) Date of Patent: Jun. 18, 2019

(54) CEMENTED TUNGSTEN CARBIDE BODIES HAVING A COBALT-BORON ALLOY MATRIX

(71) Applicant: International Diamond Services, Houston, TX (US)

(72) Inventors: Samer Alkhalaileh, Dublin, OH (US); Zheng Chen, Flemington, NJ (US); Yuming Jiang, Zhengzhou (CN)

(73) Assignee: Suzhou Superior Industrial Technology Co. Ltd., Suzhou, Jiangsu (CN)

( * ) Notice: Subject to any disclaimer, the term of this patent is extended or adjusted under 35 U.S.C. 154(b) by 0 days.

(21) Appl. No.: 14/611,457

(22) Filed: Feb. 2, 2015

(65) Prior Publication Data

US 2016/0221152 A1 Aug. 4, 2016

Related U.S. Application Data

(60) Provisional application No. 61/939,433, filed on Feb. 13, 2014, provisional application No. 61/934,047, filed on Jan. 31, 2014.

(51) Int. Cl.
*B24D 3/06* (2006.01)
*B24D 18/00* (2006.01)

(52) U.S. Cl.
CPC ..... *B24D 3/06* (2013.01); *B24D 18/0009* (2013.01)

(58) Field of Classification Search
CPC ..... E21B 10/46; E21B 10/567; B24D 3/06; B24D 18/0009
See application file for complete search history.

(56) References Cited

U.S. PATENT DOCUMENTS

2006/0266558 A1* 11/2006 Middlemiss ..... B22F 7/062 175/426
2013/0092451 A1* 4/2013 Mukhopadhyay ..... B01J 3/062 175/428
2014/0231151 A1* 8/2014 Matthias ..... B24D 18/0009 175/432

FOREIGN PATENT DOCUMENTS

WO WO 2009/147629 * 12/2009 ..... B01J 3/06

* cited by examiner

*Primary Examiner* — Pegah Parvini
(74) *Attorney, Agent, or Firm* — Taylor Intellectual PLLC; James W. Taylor, II

(57) ABSTRACT

A cobalt-boron alloy is used as the matrix in a polycrystalline diamond compact. The matrix is hot isostatic pressed with tungsten carbide to form a substrate. The substrate is then high-pressure, high temperature sintered with a diamond powder, preformed and acid-leeched diamond plate, or another ultra-hard material in a press mold to sweep the matrix, thereby creating an ultra-hard polycrystalline compact at a temperature 400° C. lower and with less graphitization than conventional techniques using cobalt binder. The compact is stronger and has a longer useful life than conventional compacts.

19 Claims, 3 Drawing Sheets

CEMENTED TUNGSTEN CARBIDE BODIES HAVING A COBALT-BORON ALLOY MATRIX

This application claims priority under 35 U.S.C. 119(e) based upon Provisional Application Ser. No. 61/939,433 entitled "Polycrystalline Diamond Composite With Cobalt-Boron Alloy Cemented Tungsten Carbide Matrix" filed Jan. 31, 2014 and Application Ser. No. 61/934,047 entitled "Polycrystalline Diamond Composite with Cobalt-Boron Alloy Cemented Tungsten Carbide Matrix" filed Feb. 13, 2014, which are incorporated herein by reference in their entirety.

FIELD OF THE INVENTION

The present invention relates to a cemented metallic body, exemplified as a polycrystalline diamond compact ("PDC"), wherein a tungsten carbide matrix additionally comprises boron. As will be discussed below, the invention was developed for the oil and gas field drilling industry, but can nevertheless be utilized in virtually any field that requires drilling and/or machining tungsten carbide bodies to be utilized under shear, friction, and/or abrasion.

BACKGROUND OF THE INVENTION

Cemented metallic bodies ("CMBs") are structurally strong and have good wear resistance under extreme environment, such as shear, abrasion, friction, and heat. Due to these advantages, CMBs are utilized for high-speed cutting or drilling tools, for molding dies, and for wear resistance components. A particularly important application is a CMB's use in the manufacture of ultra-hard compacts, such as polycrystalline diamond composites ("PDCs") and polycrystalline cubic boron nitride ("PcBN").

A particularly important CMB is the metallic-tungsten carbide ("m-WC") material used as the substrate of PDCs. PDCs are generally used as drilling tools that are expected to be put under extreme shear, high friction, severe abrasion, and internal forces. PDCs are generally a construction of two components: a diamond plate and its attached substrate. Such an ultra-hard compact is generally prepared in two steps. First, the m-WC substrate is normally prepared by hot isostatic pressing ("HIP"), sintering around a 6-20 weight percent loading of tungsten carbide ("WC") powder into metallic catalyst matrix—such as cobalt—under isostatic gas pressure. In HIP, the temperature of m-WB mixture is increased to the melting point of the metallic catalyst matrix component, and the metal matrix melts. Yet tungsten carbide grains, due to a relatively higher melting point, remain in the solid phase. As a result of this process the matrix embeds and cements the carbide grains thereby creating a hard material with distinct material properties. As a second step, diamond powder is placed in a PDC press mold and sintered while the m-WC substrate is placed on top of the powder in the PDC mold, sintering takes place under a high-pressure, high temperature process ("HPHT") by a PDC press mold in a sintering device. When the substrate metallic catalyst matrix melts in the HPHT sintering operation, it partially sweeps (i.e., penetrates interstitial spaces) from the substrate into the plate, creating a two-layer composite with a single matrix combining the two components: the plate having diamond grains wet by metallic catalyst matrix and the substrate being substantially only m-WC, with a lower concentration of matrix due to some portion of it sweeping into the plate. The metallic catalyst promotes a carbon-carbon reaction between diamond grains that result in $sp^3$ hybridized carbon bonds between adjacent diamond grains, thereby creating an ultra-hard diamond skeleton in the plate.

A conventional end product is shown in FIGS. 1 and 2. PDC 100 comprises a diamond plate 110 and a substrate 120. The diamond plate has a rake 114—that is not responsible for cutting but instead helps remove cut material—and flank 112, which performs abrasion. The diamond plate 110 and the substrate have an interface 130.

The construction is composed of two layers, the top layer is a PDC layer (i.e., the plate), which has been sintered to a substrate, thereby sharing a matrix phase. The plate is utilized for cutting or drilling operations, and the substrate is used as a shock absorber and an interface between the plate and the rest of a tool. In the case of a braze joint, the interface is stronger between two metallic components, and therefore the nature of the substrate becomes critical when attaching it to other components.

One significant problem with conventional PDCs is that as the temperature and pressure of the process is reduced back to atmospheric conditions at the end of the manufacturing operation the PDC cools but the cobalt matrix and diamond grains have different coefficients of thermal expansion ("CTE"), which results in different amounts of volume change in between the diamond grains and the interstitial spaces. The net result of this effect is internal stress being built up within the PDC itself. Like all such processes, a dynamic energy minimum is achieved. While the diamond-particle-to-diamond-particle bonds are strong, significant stress exists within the plate and extreme stress generally exists at the interface between the plate and the substrate. When in use PDCs are exposed to abuse, such as abrasion, shear, and friction- and environment-induced high temperatures, such as 700° C. or even higher, which exacerbates an already significant amount of residual stress. Therefore during use when the PDC has higher energy to break bonds, these internal stresses, shear, and abrasion synergize in an unfavorable manner that can cause micro-cracks, which over time degrade the product, potentially causing fracture or total failure. Of all the synergizing effects, it is believed that temperature has the largest influence over the product's failure. In order to overcome this deficiency, fabrication of a thermally stable polycrystalline compact ("TSP") is desirable.

One conventional method to fabricate it TSP is using a catalyst that has a similar CTE as diamond. Silicon is the most common catalytic matrix. Silicon reacts with the diamond during the high temperature and high pressure step of compact sintering to form silicon carbide links between diamond particles. Both silicon and silicon carbide exhibit a CTE relatively similar to diamond. Therefore, the resultant compact is considered thermally stable because it can withstand temperatures as high as 1100° C. without significant deterioration of abrasion or shear resistance. (See U.S. Pat. No. 8,020,644, which is incorporated herein by reference.) However, PCD made utilizing silicon as a binder does not have similar properties to PCD made utilizing catalytic cobalt. Instead of forming diamond-to-diamond sp3 bonds between adjacent diamond grains (through bridges based on carbon-carbon bonds), the large majority of diamond grains are attached to each other through silicon bridges based off of silicon-carbon bonds. While carbon atoms at the surface of adjacent diamond grains may still form carbon-carbon bonds due to limited graphitization, silicon acts as the major bridge linking the diamond grains together. Silicon-carbon bonds have significantly less strength than the carbon-carbon sp3 bonds. Hence despite the fact that heating has a lower relative effect on the performance of the compact and a TSP is indeed fabricated because the PDC is thermally stable, because the carbon skeleton structure is significantly weaker, the overall performance of silicon-matrix TSPs is inferior to cobalt-matrix PDCs.

Another method of forming a TSP has been used. Specifically overcoming the different CTE of the binder's catalyst and the diamond in the face can be accomplished by catalyst-leaching (e.g., an acid treatment to leach cobalt) after fabrication. This method has been performed such that little-to-no cobalt catalytic material remains in the plate. This technique has been shown to significantly improve the plate's thermal resistances on abrasion resistance of the plate, at the cost of increasing the brittleness of the plate. (See U.S. Pat. Nos. 4,104,344, 4,288,248, and 8,020,644, all of which are incorporated by reference.) However, this method also deteriorates the usually-metallic substrate due to acid corrosion. Therefore, care should be taken to protect the substrate from acid corrosion while leaching the PDC, or other manufacturing steps are necessary in order to prepare the leached compact for use.

Therefore, there is a need for a more durable PDC that is easy to manufacture and that has the ability to withstand high temperatures, abrasion, and shear with less probability of fracture or total failure in a given amount of time, without the disadvantages of those methods that have been proposed before.

SUMMARY OF THE INVENTION

A method of manufacturing an ultra-hard compact is provided, comprising providing a cobalt-boron alloy ("CoB"); providing a first particular material; performing a combination operation to combine the particular material into the alloy to create a solid sol medium with the alloy as the continuous phase and the particular material as the dispersed phase. Optionally, the method comprises: providing a second hard particulate; bringing the second hard particulate into contact with the solid sol; providing enough heat and pressure to melt the continuous phase of the solid sol so that the continuous phase melts and penetrates the contacted second hard particulate; and removing the heat and pressure to solidify a two-layered composite product.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION

Figure 1:
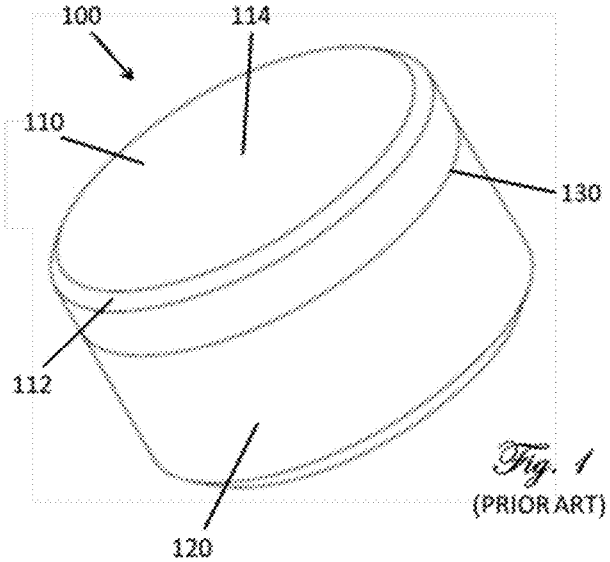
Fig. 1 (PRIOR ART)
FIG. 1 is a perspective view of a conventional PDC.
Figure 2:
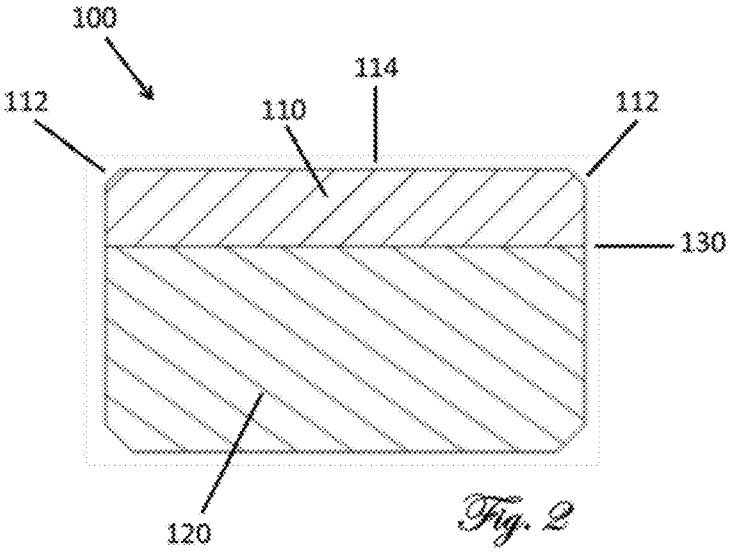
Fig. 2 (PRIOR ART)
FIG. 2 is a schematic view of a conventional PDC.

For the purpose of promoting an understanding of the principles of the claimed technology and presenting its currently understood best mode of operation, reference will be now be made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would typically occur to one skilled in the art to which the claimed technology relates. Further, while PDC is exemplified and literally means polycrystalline diamond compacts, it is to be understood that the inventive CoB can be used in PcBN or other ultra-hard compacts or other tools in the cutting, boring, and drilling arts without exceeding the scope of the present invention. Using CoB in other tool or substituting other ultra-hard materials for diamond in a compact are trivial in nature and well within the skill of one of ordinary skill in the art.

PDC

A first embodiment of the invention will be formed by the following general methodology. The PDC comprises a substrate and a plate according to the disclosure. The substrate is a CoB matrix with a hard-grained material therein, e.g. prepared by HIP operation. The plate comprises an ultra-hard material formed from an ultra-hard powder or other particulate material that has been swept penetrated such that the interstitial spaces has been filled by matrix that may catalytically react with the ultra-hard powder and or particulate to create particulate-to-particulate bonds to create an ultra-hard skeleton), e.g. during an HPHT operation.

Because the melting temperature of the CoB matrix is significantly lower than that of cobalt, the internal stresses caused by temperature changes (and thus volume changes) not as significant. As such, the compact as a whole is stronger. This causes a significantly less chance of compact failure in use and leads to a longer useful life.

In a second embodiment of the invention, a method of manufacturing a TSP comprises providing a conventional PDC that uses cobalt or any other art-established matrix. The diamond plate is removed from the substrate (e.g., via a cutting operation). The diamond plate is then leached to remove any matrix, leaving only the diamond plate with as interstitial spaces voided. This creates a TSP plate, although the plate is structurally weak due primarily to large voids and no internal support in those interstitial spaces. Alternatively, a TSP that is pre-leached can be provided. A substrate comprising a CoB matrix with a hard-grained material therein (e.g., formed by an HIP operation) is then abutted next to the diamond plate in a press mold. A sintering operation is performed (e.g., HPHT) such that the substrate's matrix sweeps into the plate filling the interstitial spaces.

Figure 3:
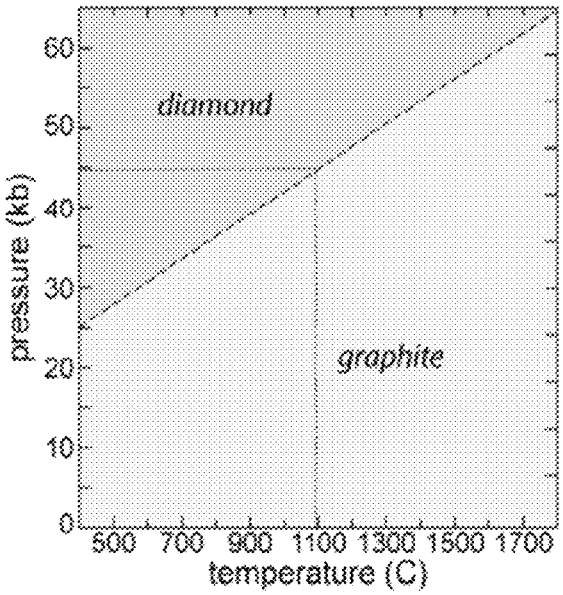
FIG. 3 is a simplified product diagram between diamond and graphite as a function of pressure and temperature, showing the graphite-diamond equilibrium line.
Figure 5:
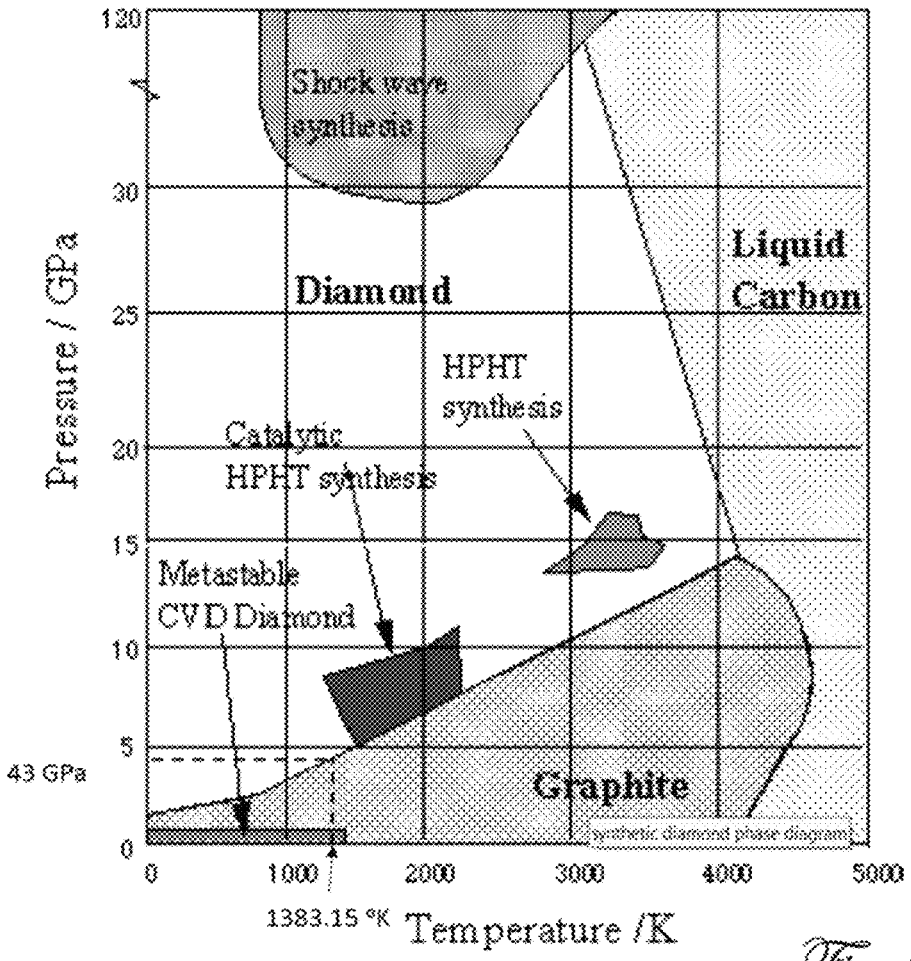
FIG. 5 is a more comprehensive product diagram between diamond and graphite as a function of pressure and temperature showing the regions for HPHT synthesis.

Because the processing temperature of the substrate reattachment can be done at the melting point of CoB, which is lower than the generally used cobalt, there is less temperature shift at the interface, and therefore using this technique, PDC is created with relatively less stress at the interface between the plate and the substrate. Lower temperature of PDC results in less graphitization. Further, as shown in FIGS. 3 and 5, as the temperature of a treatment drops, the requisite pressure to maintain diamond (to prevent graphitization of that diamond) is lower. This is extremely beneficial as high pressure risks crushing the TSP precursor plate because there is no matrix to fill those voids, and thus there is no internal support in the plate to withstand external pressure.

CoB Matrix

A cobalt boron alloy is proposed to fabricate a PDC in disc or powder format. The cobalt boron alloy is used as the matrix in the fabrication of a PDC compact. The matrix is generally mixed with the substrate's hard-grained materials in a first sintering operation to create the substrate. While an HIP operation is envisioned, any art standard technique can be used to accomplish this operation. The net result is a solid sol, wherein the continuous phase is the matrix and the discrete phase is the hard-grained material.

After the substrate is formed, the substrate may be abutted next to an ultra-hard material and sintered together in inter alia a press mold, such that the CoB sweeps into the ultra-hard material, solidifying to create a two layer structure: the substrate (diluted of some matrix) and an ultra-hard plate. HPHT sintering may be used for the second sintering step, but ultimately any art standard sintering technique may be useful. As the invention will demonstrate below, CoB matrix lends itself to several advantages:

First, as will be understood from FIGS. 3 and 5, subjecting the diamond grains to relatively low temperatures during PDC manufacturing, reduces the occurrence of diamond grain graphitization, which will result in better quality PDC. Graphitization is the back conversion of diamond to graphite; this takes place when diamond grains are heated to elevated temperatures. The present inventors believe that higher temperature without compensating with higher pressures causes more severe graphitization. Graphitization of diamond has been observed to occur at temperatures as low as 500° C. under atmospheric pressure. Applying pressure to the diamond grains at elevated temperatures will slow down or stop graphitization from taking place, and will stabilize the diamond structure. However, during the manufacturing process of PDC, diamond grains are subjected to temperatures well above 500° C. while the environment pressure is being increased, but due to the nature of the manufacturing process, where the diamond grains are placed in a refractory metal container and pressure is applied to the whole PDC body, diamond grains may not be subjected to the full system pressure until the molten metallic catalyst matrix diffuses into the diamond grains, which is kinetically slower than thermal equilibration, and therefore many localized pockets of high temperature and low pressure are expected, which results in diamond breaking down into graphite, a significantly weaker material. The closer to the diamond region in a diamond/graphite product diagram that one can get, the less graphitization will take place as noted above. Therefore, by bringing the manufacturing temperature down almost 400° C. at a similar pressure, the diamond region of the plot becomes much closer, and there are less localized regions sufficient to form graphite and therefore significantly less graphitization.

Second, one of the biggest challenges in the manufacture of PDC is management of the residual stress within the diamond table and at the interface between the WC substrate and the PDC layer. The residual stress is proportional to the sintering temperature of the PDC. Higher temperatures cause higher residual stress. Again, high temperature appears to cause problems. Therefore, lowering the sintering temperature of PDC by utilizing CoB as the metallic catalytic matrix will result in tower residual stress within the PDC layer and at the interface.

Third, one of the biggest costs to manufacture PDC is the cost of carbide tooling. Carbide tooling life is measured by the number of cycles it is used to make PDC. A typical carbide tooling life is 1200 press cycles. Two factors which have the most detriment effect on carbide life are the operating temperature and pressure. If either one of these two can be reduced, carbide tooling life will be increased, which will have a significant effect on tool cost.

Fourth, the gasket material effectiveness in maintaining cell pressure is affected significantly by the operating temperature. Lower operating temperature is more favorable for the gasket material function.

Lastly, there are other minor benefits from running the HPHT system temperature at a lower set value, such as reduced cost of heating and cooling along with the maintenance costs of the production system.

Figure 4:
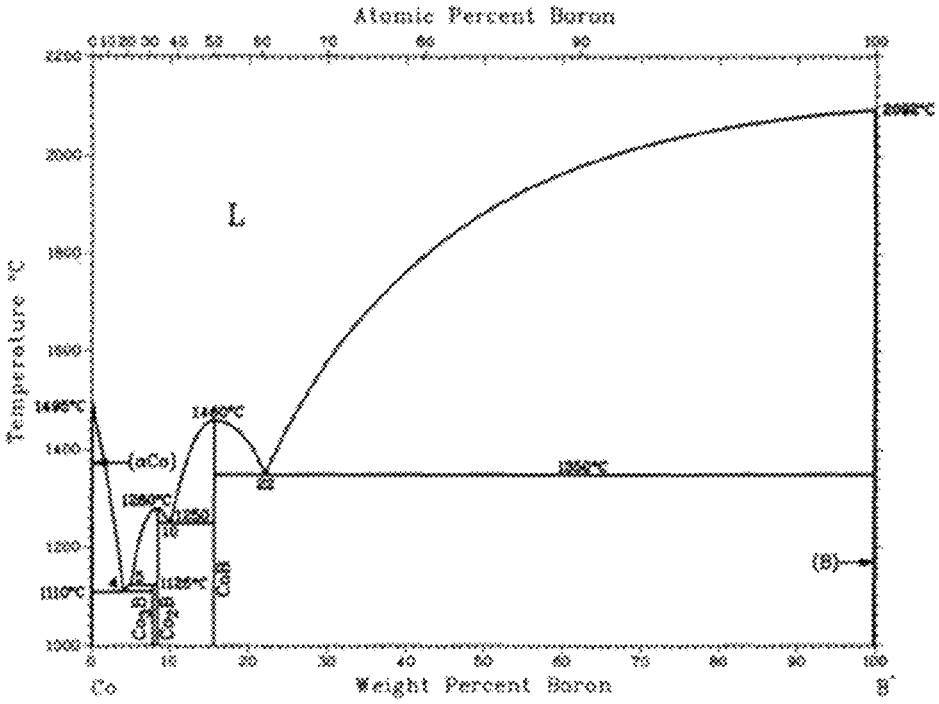
FIG. 4 is a phase diagram of CoB as a function of the weight percent of boron in the CoB.

Referring now to FIG. 4, a phase diagram of the melting temperature of CoB as a function of the weight percent (i.e., equivalently plotted as atomic percent) of boron in the CoB is provided. Of particular note, there are three eutectic points between boron and cobalt, which is believed to correspond to the three different cobalt borides formed: CoB, $Co_2B$ and $Co_3B$. These eutectic temperatures are preferred compositions (the first at about 4 wt. % boron, the second at about 11 wt. % boron, and the third at about 22 wt. % boron) as it is understood that at these eutectic temperatures, the entire matrix melts as a whole instead of the boron melting and the cobalt staying solid until higher temperatures are reached. Further, these eutectic temperatures exhibit melting point minimums. A preferred composition is about 1-40 wt. % boron in the COB matrix. A more preferred composition is about 2-25 wt. % boron in the CoB matrix. An even more preferred composition is about 2.5-15 wt. % boron in the CoB matrix. An even more preferred composition is about 3-7 wt. % boron in the CoB composition matrix. The most preferred composition is about 4 wt. % boron in the CoB matrix because this is the apparent melting point minimum for the entire phase diagram. The ratios of cobalt to boron at the second and third eutectic weight ratios of cobalt to boron may also be a desirable CoB matrix composition, such as about 7-15% boron, 10-12 wt percent boron, about 11 wt. % boron, 20-25 wt. % boron, 21-23 wt. % boron, and about 22 wt. % boron.

Substrate's Hard Grained Material

The substrate comprises a hard grained material that is sintering processed (preferably an HIP process) with the matrix at the start of the PDC fabrication operation to create a solid sol. The hard grained material will be the dispersed phase in the matrix's continuous phase. The loading of the hard grained material can be about 5 to 40 wt. %, preferably 6-20 wt. %, and even more preferably 7-15 wt. %. This material has a large influence on the physical properties of the substrate and its ability to absorb and withstand impacts and shocks. The hard grained material can be hard grain or hard powder material, preferably tungsten carbide. However, any art recognized hard substrate material can be used. Further, while powder or grains is envisioned, the physical form does not need to be such particulates. Other physical forms may be useful.

Plate's Ultra-Hard Material

The plate comprises an ultra-hard powder material that is swept with matrix during a sintering operation, preferably a HPHT process. This material will generally be the major component of the plate and is primarily responsible for the grinding, cutting, or drilling operations of the resultant PDC. The ultra-hard material can be powder material, preferably diamond or cubic boron nitride. Most preferably the material is diamond powder. However, any art recognized ultra-hard substance can be used. Further, while powder is envisioned, the physical thrill does not need to be such particulates. Other physical forms may be useful. Generally the ultra-hard material will be at least 50 volume % of the resulting plate.

Preferably it will be at least 75 volume % of the resulting plate. More preferably it will be at least 80 volume % of the resulting plate, or alternatively 85 volume % of the resulting plate. Most preferably it will be at least about 90 volume % of the resulting plate.

Several novel products have been fabricated to test the efficiency of these considerations, utilizing the lower melting temperature of the COB catalyst.

EXAMPLE 1

A cemented tungsten carbide is sintered with a CoB alloy as the matrix ("WC-CoB"). The matrix was about 4 wt. % boron and 96 wt. % cobalt. The WC-CoB matrix is formed as an HIP sintering operation at 1110° C. at about 20,000 Psi. This serves the purpose of being at CoB's first eutectic melting temperature and has an isostati c pressure. This temperature and pressure were maintained for 300 minutes, which is believed to be sufficient such that the molten CoB penetrates and fills all the interstitial spaces between the WC grains and forms a roughly homogeneous solid. The resultant cemented WC-CoB is a matrix of hard WC grains embedded in a CoB alloy matrix.

EXAMPLE 2

A PDC was made utilizing product of Example 1 as a substrate material.

The material of Example 1 was created in the shape of a PDC substrate by performing HIP in a substrate press mold. Diamond powder was charged into a PDC press mold and then the PDC substrate from example 1 was place into the mold above the powder. A HPHT sintering operation was performed at a temperature of 1110° C. and a pressure of 43-45 KBar.

The resulting PDC was properly sintered and visually appeared to be of a quality for use. Because the CoB alloy has a first eutectic melting temperature of 1110° C. (i.e., 1383.15° K.) instead of 1495° C. (i.e., 1768.15° K.) as does pure cobalt, using CoB as the matrix allows a lower sintering temperature. This lower temperature means that the difference between the sintering temperature and atmospheric conditions is minimized, and therefore volume changes due to difference between the CTE of CoB and WC are minimized. Ergo the resulting WC-CoB material has internal residual stress within the cemented WC, causing less synergy between the internal stress, heating, abrasion, and the friction when in use. The net result is fewer micro-cracks, which increases the useful lifetime of the product and the mean time until failure.

COMPARATIVE EXAMPLE 1

The PDC of Example 2 was created using cobalt as the metallic matrix. All other conditions were held to be the same as Example 2, including the sintering temperature and pressure.

The PDC of this comparative example failed to sinter and merely compressed the diamond powder on the plate and was unfit for service.

COMPARATIVE EXAMPLE 2

An important product used for drilling in the oil and gas industry is diamond impregnated tungsten carbide inserts. This product is made using the same manufacturing process used to make cemented tungsten carbide (i.e., substrates) with the addition of diamond grains to the Tungsten Carbide grains.

A blend of WC grains and diamond grains is created by mixing diamond and WC particulates. The mixture was then blended with cobalt and a wax binder. The mix of WC, diamond grains, cobalt, and wax was pressed into the general shape of the insert's form to form a precursor part (i.e., a green carbide part).

The precursor part was then HIP sintered. During the HIP sintering process, the green part was subjected to temperatures close to 1500° C. for about 5 hours to allow the cobalt binder to melt, and penetrate within the interstitial spaces between the WC and diamond grains, thereby displacing the molten wax. While the environmental temperature during HIP sintering is raised, so is the environmental pressure. However, the pressure applied during HIP sintering was in the neighborhood of 20,000 PSI, significantly below the pressure needed for the diamond grains to stay in the diamond stable region at 1500° C. This condition results in thermal damage to the diamond grains blended with the WC and Co mix.

EXAMPLE 3

An insert was created using the technique discussed in Comparative Example 2, except the cobalt metallic catalytic matrix was replaced with 1:24 weight ratio of cobalt-to-boron matrix, and the sintering operation was performed at 1110° C.

The observed result was significantly less damage to the diamond gains, which was very clear upon visual inspection.

EXAMPLE 4

A conventional PDC was purchased. The plate was separated from the substrate via a cutting operation. The plate was acid leeched for several hours to remove any matrix from the plate. The plate was HPHT sintered at 1110° C. at 43 KBar with the substrate of Example 1 in a pressure mold. The resulting TSP is a better product and has improved product yield.

The invention claimed is:

1. A method of manufacturing a thermally-stable compact comprising:

providing a cobalt-boron alloy;

providing a first particulate material;

performing a combination operation to combine the particulate material and the alloy to create a solid sol substrate with the alloy as the continuous phase and the first particulate material as the dispersed phase;

providing a plate precursor material selected from the group consisting of: a second hard particulate and a pre-formed ultra-hard skeleton plate;

bringing the plate precursor material into contact with the substrate;

providing enough heat and pressure to melt the continuous phase of the solid sol so that the continuous phase sweeps the plate precursor material, and—the case of a second hard particulate as the plate precursor material—the second hard particulate material undergoes a reaction to form particle-to-particle bonds; and removing the heat and pressure to solidify a thermally-stable two-layered composite product;

wherein the temperature of the melted continuous phase never reaches the melting temperature of pure cobalt.

2. The method of claim 1, wherein the first particulate material is tungsten carbide.

3. The method of claim 1, wherein the first particulate material is present in the solid sol substrate at a loading of 5 to 40 volume percent.

4. The method of claim 1, wherein the cobalt-boron alloy comprises about 2-25 wt. % boron.

5. The method of claim 4, wherein the cobalt-boron alloy comprises about 3-7 wt. % boron.

6. The method of claim 5, wherein the cobalt-boron alloy comprises about 4 wt. % boron.

7. The method of claim 1, wherein the solid sol substrate is substantially homogenous before being brought into contact with the plate precursor material, and wherein the heat and pressure are maintained long enough and sufficiently high such that the continuous phase of the solid sol can sweep substantially all of the interstitial spaces of the plate precursor material before the heat and the pressure are removed.

8. The method of claim 1, where in the plate precursor material and the solid sol are brought into contact in a pressure mold.

9. The method of claim 1, wherein the plate precursor material is diamond powder, and the composite product is a polycrystalline diamond compact.

10. The method of claim 1, wherein the plate precursor material is either a diamond powder or a preformed, cobalt-free diamond-plate, and the thermally-stable compact is a thermally-stable polycrystalline diamond compact.

11. The method of claim 1, wherein the second hard particulate is cubic boron nitride powder, and the composite product is a polycrystalline cubic boron nitride compact.

12. A thermally-stable compact manufactured according to claim 1.

13. The compact of claim 12, wherein the cobalt-boron alloy comprises about 2-25 wt. % boron, wherein the thermally-stable compact has lower internal stresses than comparable compacts made with a cobalt continuous phase and are not as brittle as thermally-stable compacts with a acid-leached continuous phase.

14. The compact of claim 13, wherein the cobalt-boron alloy comprises about 3-7 wt. % boron.

15. The compact of claim 12, wherein the plate precursor material is diamond powder.

16. The compact of claim 12, wherein the plate precursor material is diamond powder and the thermally stable compact is a thermally-stable polycrystalline diamond compact.

17. The compact of claim 12, wherein the plate precursor material is cubic boron nitride powder.

18. A method of using the compact of claim 12, comprising cutting a material, boring a well, or drilling a subterranean feature.

19. The method of claim 1, wherein the temperature of the melted continuous phase does not exceed 1110° C.

* * * * *